US005647307A

United States Patent [19]

Clarke et al.

[11] Patent Number: 5,647,307

[45] Date of Patent: Jul. 15, 1997

[54] VALVING FOR DUAL COMPRESSION/ EXPANSION ENGINE AND METHOD OF ASSEMBLING THE SAME

[75] Inventors: John M. Clarke, Chillicothe; David E. Hackett, Washington, both of Ill.

[73] Assignee: Caterpillar Inc., Peoria, Ill.

[21] Appl. No.: 598,719

[22] Filed: Feb. 8, 1996

[51] Int. Cl.[6] ..... F02B 59/00

[52] U.S. Cl. ..... 123/42; 123/50 R

[58] Field of Search ..... 123/42, 51 A, 123/51 B, 51 BD, 50 R, 50 A, 50 B

[56] References Cited

U.S. PATENT DOCUMENTS

| | | | |
|---|---|---|---|
| 1,914,707 | 6/1933 | Wolf . | |
| 2,153,899 | 4/1939 | Shover . | |
| 2,361,700 | 10/1944 | Mathis . | |
| 2,393,085 | 1/1946 | Wuehr . | |
| 3,394,683 | 7/1968 | Erick . | |
| 3,528,394 | 9/1970 | Cummins . | |
| 3,528,396 | 9/1970 | Cummins . | |
| 3,550,568 | 12/1970 | Peterson . | |
| 3,991,729 | 11/1976 | Notaro . | |
| 4,437,437 | 3/1984 | Erickson | 123/50 R |
| 4,671,228 | 6/1987 | Tomita et al. . | |
| 4,753,198 | 6/1988 | Heath . | |
| 4,765,287 | 8/1988 | Taylor et al. . | |
| 4,773,358 | 9/1988 | Heath . | |
| 5,133,306 | 7/1992 | Honkanen . | |
| 5,341,774 | 8/1994 | Erickson | 123/42 |
| 5,456,219 | 10/1995 | Clarke | 123/42 |

*Primary Examiner*—Marguerite McMahon
*Attorney, Agent, or Firm*—Lawhorn, Simpson & Polsley

[57] ABSTRACT

An improved valving configuration for dual compression/ expansion engines having multiple, relatively small diameter intake transfer valve assemblies disposed about a fuel injection apparatus in the internal housing, a relatively large diameter exhaust transfer valve assembly including a valve, spring apparatus, valve seat and cage for assembly into the internal housing, and a method of assembling the transfer valves to the internal housing including assembling the intake transfer valves to the internal housing through the exhaust transfer valve assembly aperture in the internal housing prior to securing the exhaust transfer valve assembly to the internal housing.

33 Claims, 2 Drawing Sheets

FIG. 1
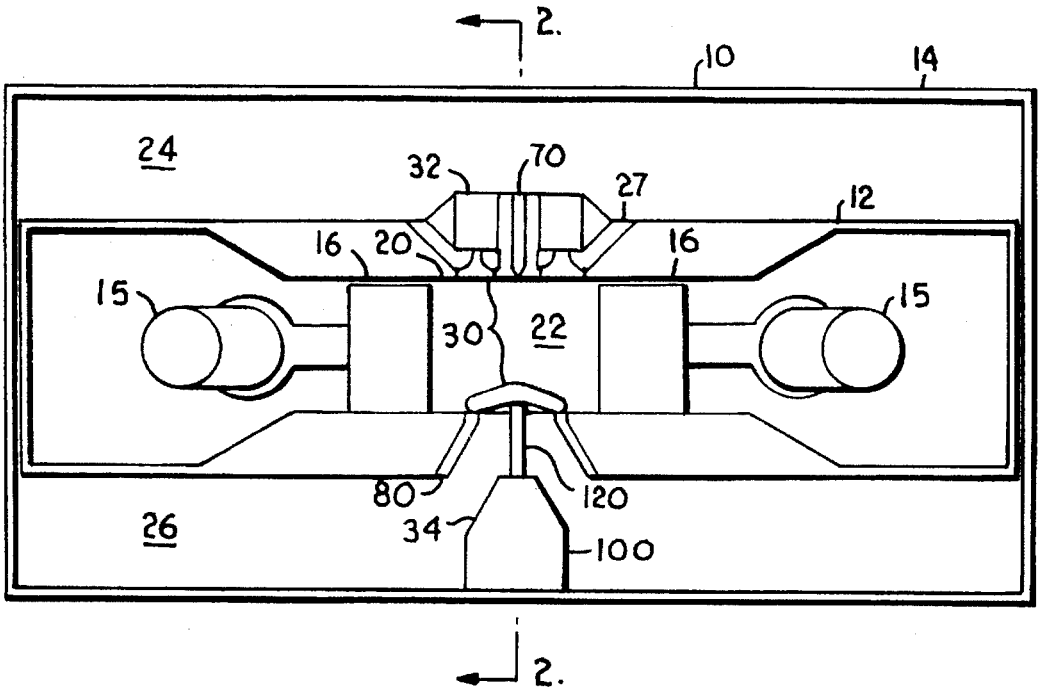
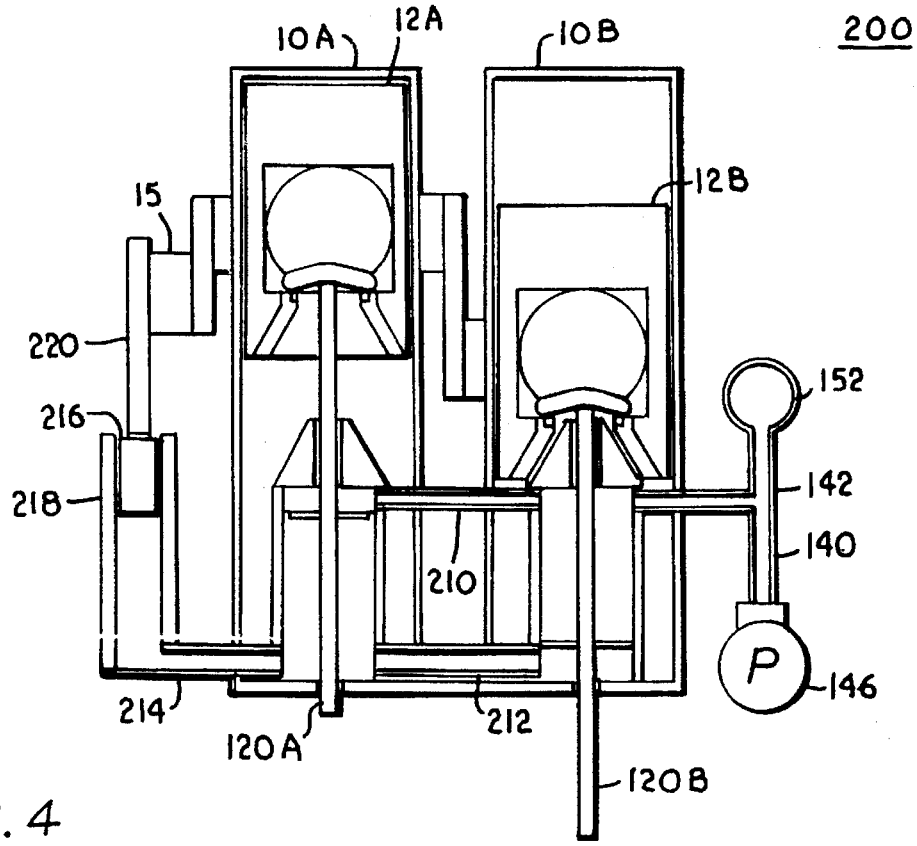
FIG. 4

FIG. 2
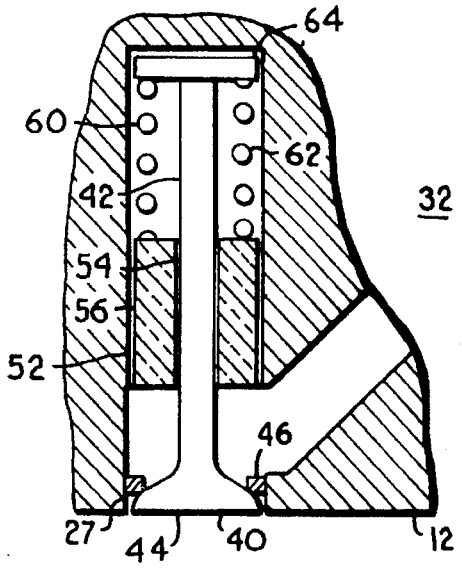
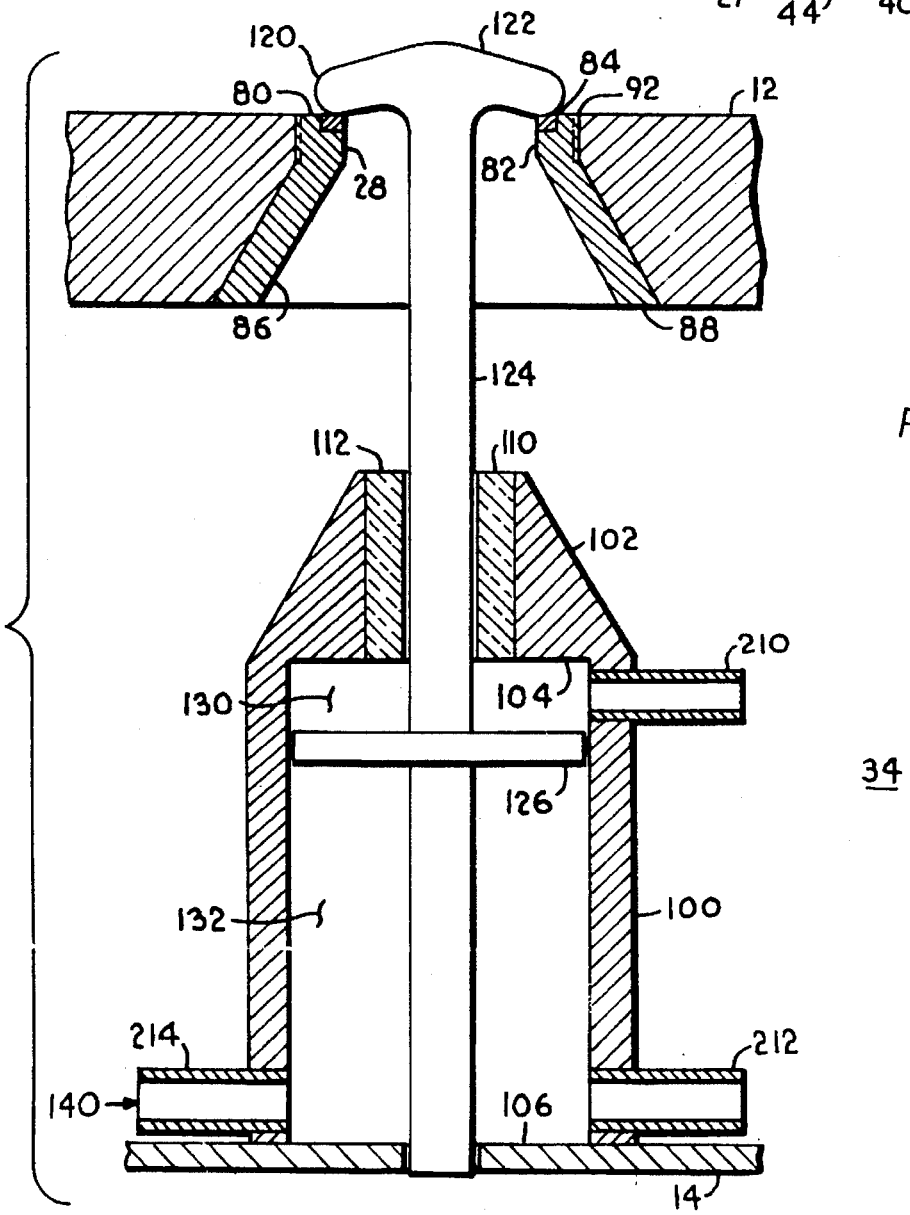
FIG. 3

VALVING FOR DUAL COMPRESSION/ EXPANSION ENGINE AND METHOD OF ASSEMBLING THE SAME

TECHNICAL FIELD

This invention generally pertains to dual compression/dual expansion engines, and more particularly to transfer valve configurations and transfer valving for such engines and to methods of assembling the transfer valving for such engines.

BACKGROUND ART

There are numerous methods known in the prior art for providing valve controlled fluid flow in internal combustion engines, and particularly in piston-type engines. Such valves may include pressure-differential responsive poppet-type valves and valves responsive to mechanical actuators such as cams or pushrods. Typical piston-type internal combustion engines are provided with valves disposed in the cylinder head, know as valve-in-head, which permits both relatively simple assembly and operation. A mechanical actuator for operating a valve in such a typical valve-in-head assembly can be located at a fixed position relative to both the valve and the piston crankshaft to ensure proper timing of the valve.

In a dual compression/dual expansion internal combustion engine, such as that disclosed in U.S. Pat. No. 5,456,219, the combustion chamber is disposed within an internal housing or body which oscillates within the external housing of the engine. It is necessary in such an engine to provide one or more intake valves to permit a controlled flow of the initial intake of air into the low pressure compression chamber, and one or more exhaust valves to permit a controlled flow of air and exhaust products from the low pressure expansion chamber. However, in such engines it is also necessary to provide one or more intake transfer valves to permit a controlled flow of air from the low pressure compression chamber to the combustion chamber and one or more exhaust transfer valves to permit a controlled flow of air from the combustion chamber to the low pressure expansion chamber. The intake transfer valves and the exhaust transfer valves must be disposed on and oscillate with the internal body of the engine and are not in a position which is fixed relative to the engine crankshaft. Furthermore, the internal body of such an engine includes two pistons operating in opposition to each other, and there is no cylinder head as such in which a valve assembly and actuators may be conveniently disposed according to the typical valve-in-head configuration. Therefore, an appropriate disposition of the valves and actuating means must be provided.

Furthermore, the typical valve actuating means operates to actuate valves in a fixed position relative to the engine crankshaft, whereas the valve actuating means in a dual compression/dual expansion engine operates on valves which are not fixed relative to the engine crankshaft. The motion of the valves relative to the engine crankshaft, with the resulting changes in distance between the valves and the axis of the engine crankshaft, would require a relatively more complex valve actuating means. Furthermore, even in the event that a mechanical valve train is employed as the valve actuating means, the motion of the internal housing subjects the valve actuating means to substantial forces and accelerations. This increases both the physical size and mass of the components undesirably, in turn increasing the size and weight of the engine. These factors, taken together, essentially prevents the use of the typical valve actuating means.

In addition, the typical valve-in-head assembly can be assembled prior to the installation of the head onto the engine block assembly. Since the internal housing must be assembled prior to installation into the external housing of a dual compression/dual expansion engine, there is no opportunity to assemble conveniently a typical valve actuator means to operate the transfer valves after the basic engine structure of the internal housing and external housing has been assembled.

Therefore, it is an object of the present invention to provide improved valving for a dual compression/dual expansion engine.

It is another object of the present invention to provide such improved valving in the intake transfer valves of the dual compression/dual expansion engine.

It is yet another object of the present invention to provide such improved valving in the exhaust transfer valves of the dual compression/dual expansion engine.

It is a further object of the present invention to provide such improved exhaust transfer valving with an improved valve actuating means.

It is yet a further object of the present invention to provide such an improved exhaust transfer valve actuating means as will substantially reduce the number and size of components required for operating the exhaust transfer valve.

It is yet another object of the present invention to provide such an improved exhaust transfer valve actuating means as will operate reliably.

It is yet another object of the present invention to provide such an improved exhaust transfer valve actuating means as will require relatively low maintenance during its operating lifetime.

It is a further object of the present invention to provide such an improved exhaust transfer valve actuating means as will be relatively inexpensive to manufacture.

It is yet a further object of the present invention to provide a method of assembling such improved valving as will reduce assembly difficulty during assembly.

It is another object of the present invention to provide such a method of assembling such improved valving as will substantially reduce assembly time.

It is yet another object of the present invention to provide such a method of assembling such improved valving as will permit simple assembly of the improved valving with the internal housing prior to assembly thereof with the external housing of the dual compression/dual expansion engine.

These and other objectives of the present invention will become apparent in the specification and claims that follow.

SUMMARY OF THE INVENTION

The subject invention is improved valving for an improved dual compression/dual expansion internal combustion engine, including pressure differential operated intake transfer valves and at least one exhaust transfer valve having an improved valve actuating means for causing positive actuation of the exhaust transfer valve, and a method of assembling the improved valving including the use of more than one relatively small intake transfer valves and one relatively large exhaust transfer valve.

BRIEF DESCRIPTION OF THE DRAWINGS

FIG. 1 shows a cross-sectional view of a dual compression/dual expansion engine apparatus including a improved valve assembly generally according to the subject invention.

FIG. 2 shows an enlarged partial cross-sectional view of the engine apparatus including the intake transfer valve subassembly of the valve assembly as shown in FIG. 1.

FIG. 3 shows an enlarged partial cross-sectional view of the engine apparatus including the exhaust transfer valve subassembly of the valve assembly as shown in FIG. 1.

FIG. 4 shows a partial cross-sectional view of a modular engine including the engine apparatus employing the improved valve assembly according to the subject invention.

DESCRIPTION OF THE PREFERRED EMBODIMENT

An engine 10 including an improved valve assembly generally according to the present invention is shown in FIG. 1 and referred to with reference number 10. Those skilled in the relevant art will understand that the described engine 10 is intended as exemplary only, and is not intended to limit the subject invention to the particular engine construction and configuration in which the subject invention is disclosed.

For purposes of description herein, a representative dual combustion/dual expansion internal combustion engine 10 is described. As an aid to understanding the drawings and description herein, the terms "upper", "lower", "right", "left", and other directional or positional references are to be understood as referring to the relative positions in the drawing Figures, and not to the subject invention as it may be employed in practice.

The engine 10 includes an internal housing 12 operating in a void defined in an external housing 14. Two axially parallel crankshafts 15 extend through both the external and internal housings 12 and 14. Two pistons 16, each operating reciprocally on a respective crankshaft 15, are disposed in a void in the internal housing 12 defined by a combustion chamber wall 20, with the pistons 16 and the combustion chamber wall 20 defining the combustion chamber 22 of the engine 10. The pistons 16 operate in opposition within the combustion chamber wall 20. The internal housing 12 separates the void in the external housing into two separate chambers: a first or primary compression chamber 24 and a second or secondary expansion chamber 26.

Turning to FIG. 2, the valve assembly 30 can be seen in greater detail. The valve assembly 30 includes an intake transfer valve subassembly 32 and an exhaust transfer valve subassembly 34. Preferably, a plurality of intake transfer valve subassemblies 32 are employed to provide the inflow of combustion gases to the combustion chamber 22 of the engine 10, while a single exhaust transfer valve subassembly 34 is provided. Preferably, the single exhaust transfer valve subassembly 34 has a volumetric flow capacity which is generally equal to the total volumetric flow capacity of the intake transfer valve subassemblies 32.

The valve assembly 30 is disposed on the internal housing 12 of the engine 10. Each of the intake valve subassemblies 32 communicates through a first aperture defined by a plurality of intake port surfaces 27 in the internal housing 12 communicating between the primary compression chamber 24 and the combustion chamber 22. The exhaust valve subassembly 34 communicates between the combustion chamber 22 and the secondary expansion chamber 26 through an aperture in the internal housing 12 defined by a generally cylindrical exhaust valve port surface 28 in the internal housing 12 to selectively permit and prevent flow communication from the combustion chamber 22.

Preferably, the intake transfer valve subassembly 32 is a poppet-type valve, as is known generally in the art. An exemplary intake transfer valve subassembly 32 includes an intake valve element 40 having a substantially cylindrical intake valve stem 42 extending distally from a planar, disk-type intake valve head 44. An annular intake valve seat is provided in the intake port surface 27. When the intake transfer valve sub-assembly 32 is in a closed, flow preventing position, the intake valve head rests sealingly against the intake valve seat 46. Flow through the transfer valve assembly 32 is permitted when the intake valve element 40 is moved linearly so that the intake valve head 44 is spaced apart from the valve seat 46.

A substantially tubular intake valve guide 52 slidingly engages at least a portion of the valve stem 42, with the intake valve stem 42 extending through the intake valve guide inner surface 54 for directing the motion of the intake valve element 40 in a linear, co-axial direction of operation. The inner diameter of the intake valve guide 52 is sufficiently close fitting to the intake valve stem 42 diameter so as to linearly guide the intake valve element 40 within a permissible range of axial mis-alignment during relative movement between the intake valve element 40 and the intake valve guide 52. To ensure that the intake valve guide 52 remains in its preferred position relative to the interior housing 22, the intake valve guide outer surface 56 is secured to internal housing 12. Preferably, the intake valve guide 52 is retained in the internal housing 12 by an interference press-fit between the guide surface 50 and the intake valve guide outer surface 56, although other means of securing therebetween may be employed, such as with welding or mutually engaging threads.

An intake valve spring means 60 includes an intake valve spring 62 and an intake valve collar 64 disposed on and affixed to the intake valve stem 42. The valve spring 62 is preferably a cylindrical helical spring which is maintained in compression between the intake valve collar 64 and the valve guide. Thus, the intake valve 40 is normally closed. Those skilled in the relevant art will understand that other types of pressure-differential operated valves may be employed according to the subject invention.

According to preferred embodiment, the intake transfer valve subassembly 32 is responsive to and operated by pressure differential between the primary compression chamber 24 and the combustion chamber 22. That is, whenever the pressure in the primary compression chamber 24 acts on the intake valve head 44 with a greater force than that exerted thereon by the combination of the intake valve spring means 60 and the pressure in the combustion chamber 22, the intake valve 42 will move in the valve guide 52 to the open position, permitting flow from the primary compression chamber 24 to the combustion chamber 22.

A fuel injector means 70 is shown disposed between the intake transfer valve subassemblies 32 in the internal housing 12. This fuel injector means 70 is preferably a typical fuel injector apparatus as is commonly known to those skilled in the relevant art.

In FIG. 3, the exhaust transfer valve subassembly 34 is disclosed in greater detail. Preferably, the exhaust transfer valve subassembly 34 includes an exhaust valve cage 80 which is coniform in shape. The relatively smaller diameter upper cage end 82 is provided with an exhaust valve seat 84 on the exhaust valve cage pocket surface 86 which forms the interior surface of the exhaust valve cage 80. The exhaust valve cage pocket surface 86 is also coniform so as to form an exhaust valve pocket or void. The exhaust valve cage 80 sealingly engages the internal housing 12 to ensure that no exhaust gases can bypass the exhaust valve cage 80. An exhaust valve cage securing means 92, preferably in the form of mutually engaging threads on the exhaust valve cage upper end 82 and a portion of the cylindrical exhaust valve port surface 18.

The exhaust transfer valve subassembly 34 also includes an exhaust valve tower 100 secured or fixed to the external housing 14 in the secondary expansion chamber 26. The exhaust valve tower 100 includes a coniform tower upper surface 102 which generally conforms to the exhaust valve cage pocket surface 86. A generally cylindrical inner tower surface 104 having a generally vertical axis is provided to define a cylindrical void within the exhaust valve tower 100. A cylindrical exhaust valve guide 110 is disposed coaxially within the inner tower surface 104, preferably in a press- or interference-fit. The exhaust valve guide 110 also includes a cylindrical exhaust valve sleeve surface 112 which is coaxial with the inner tower surface 104.

An exhaust valve element 120 including a generally coniform exhaust valve head 122 and an exhaust valve stem 124 extending distally from the exhaust valve head 122, is also provided. The exhaust valve stem 124 operates linearly on the axis of the exhaust valve sleeve surface 112, in sliding engagement therewith. An annular exhaust valve collar 126 is provided on the exhaust valve stem 124 in the inner tower surface 104 below the exhaust valve guide 110. The exhaust valve collar 126 is secured to the exhaust valve stem 124, or may be integral therewith, and is in sliding, sealing contact with the inner tower surface 104. This then forms an upper valve stem chamber 130 above the exhaust valve collar 126 in the annulus defined between the exhaust valve stem 124, the inner tower surface 104, the valve guide 110, and the exhaust valve collar 126.

The exhaust valve stem 124 further extends through an annular tower floor 106 which is fixed within the inner tower surface 104. This forms an annular lower valve stem chamber 132 below the exhaust valve collar 126 in the annulus defined by the exhaust valve stem 124, the inner tower surface 104, the tower floor 106, and the exhaust valve collar 126.

The subject invention further includes an improved method of assembling the transfer valve assemblies 30 to the internal housing 12 of the dual compression/dual expansion engine 10. The internal housing 12 is provided with a plurality of intake port surfaces 27, preferably numbering four. A similar number of intake transfer valve subassemblies 32 is also provided. As the internal housing 12 components are assembled, each of the four intake transfer valve subassemblies 32 are sequentially transferred through the relatively large exhaust port surface 28. The intake valve guide 52 of each intake valve subassembly 32 is located in their respective intake port surface 27 and secured therein. The exhaust valve element 120 and exhaust valve cage 80 are then assembled into the exhaust port surface 28. The threads which comprise the exhaust valve cage securing means 92 being those on the cylindrical exhaust valve port surface 18 and the exhaust valve cage upper end 82, are engaged together and the exhaust valve cage 80 is rotated with respect to the internal housing 12 until the exhaust valve cage 80 is securely seated in the exhaust port surface 28. The internal housing 12 may then be disposed in the external housing 14, with the exhaust valve stem 124 being operably disposed in the exhaust valve guide 110. This method permits the use of engine assembly equipment typically employed in the assembly of other types of piston engines to be utilized successfully in the assembly of the dual compression/dual expansion engine 10.

According to the preferred embodiment, the exhaust transfer valve subassembly 34 is preferably employed in a composite or modular engine 200 comprised of two engines 10, as shown in FIG. 4. For ease of reference, the individual engines 10 are designated as the first engine 10A and the second engine 10B. Those skilled in the relevant art will understand that the first and second engines 10A and 10B are substantially identical, and that the use of the terms "first" and "second" is primarily for ease of description herein.

In the modular engine 200, the individual engines 10 employ mutual crankshafts 15 which are oriented to phase the motion of the internal housings 12A and 12B to 180° out of phase, so that the internal 20 housing 12A is moving upward while the internal housing 12B is moving downward and vice-versa. The exhaust valve actuation means 140 in the modular engine 200 includes a first fluid supply line 142 to supply fluid from a fluid supply source 146. The first fluid supply line 142 also communicates fluid flow to and from a fluid accumulator 152. The first fluid supply line 142 permits fluid flow communication from the fluid supply source 146 and the fluid accumulator 152 to the upper valve stem chambers 130A and 130B.

A first fluid transfer line 210 permits fluid flow communication between the upper valve stem chamber 130A of the first engine module 10A and the upper valve stem chamber 130B of the second engine module 10B. Similarly, a second fluid transfer line 212 permits fluid flow communication between the lower valve stem chamber 132A of the first engine module 10A and the lower valve stem chamber 132B of the second engine module 10B. A third fluid transfer line 214 provides a flow connection between an exhaust valve actuator piston 216 operating linearly in an exhaust valve actuator cylinder 218, and the lower valve stem chamber 132A and 132B, and permits fluid flow responsive to movement of the exhaust valve actuator piston 216. The exhaust valve actuator piston 216 in turn is responsive to an exhaust valve actuating cam 220 so as to cause timely actuation of the exhaust valve actuation means 140.

In the modular engine 200, the exhaust valve actuation means 140 is maintained under pressure by fluid from the fluid supply source 144. When the exhaust valves 120A and 120B are in their respective normally closed positions, fluid is pumped through the first fluid transfer line 210 between the upper valve stem chambers 130A and 130B, and between the lower valve stem chambers 132A and 132B through the second fluid transfer line 212 by the oscillating vertical action of the respective exhaust valve collars 126 as the exhaust valves 120A and 120B are carried with their respective internal housings 12A and 12B.

More particularly, because of the 180° crank angle differential between the two cooperating engines 10, the internal housing 12 of one engine 10 will be moving upwardly while the internal housing 12 of the other engine 10 will be moving downwardly. The exhaust valve elements 120, being carried with their respective internal housings, will be likewise moved vertically. However, because one valve stem 124A is moving upward while the other valve stem 124B is moving downward, an equal transfer of fluid occurs between the upper valve stem chambers 130A and 130B, and between the lower valve stem chambers 132B and 132A. Therefore, no net upward force is exerted on either of the exhaust valve elements 124A or 124B, whereas a net downward force is continually exerted in the upper valve stem chambers 130A and 130B due to the fluid supply through the first fluid supply line 142, causing the exhaust valve elements 120A and 120B to remain normally closed.

Because the internal housings 12A and 12B operate 180° out of phase, their respective exhaust valves 120A and 120B are to be actuated at times which are 180° of crank angle apart. This crank angle phasing causes the combustion portion of the cycle of the engine 10A to occur during the exhaust portion of the cycle of engine 10B, and the exhaust portion of the cycle of engine 10A to occur during the combustion portion of the cycle of engine 10B. Therefore, when the exhaust valve element 120A is to be opened, the exhaust valve element 120B is closed and combustion is occurring in the combustion chamber 22B, and when the exhaust valve element 120B is to be opened, the exhaust valve element 120A is closed with combustion occuring in the combustion chamber 22A.

When either the exhaust valve 120A or 120B is to be actuated, the exhaust valve actuation piston 218 is displaced by the exhaust valve actuating cam 220. The displacement of the exhaust valve actuation piston 218 and causes a displacement of fluid from the exhaust valve actuator piston 216. The fluid thus displaced flows through the third fluid transfer line 214 and into the lower valve stem chambers 132A and 132B. The displaced fluid exerts hydraulic pressure on the exhaust valve collars 126A and 126B. However, the exhaust valve actuation means 140 is self-regulating due to the relatively high pressure exerted on the exhaust valve element 120A or 120B due to the forces of combustion in the combustion chamber 22A or 22B. Therefore, only that exhaust valve 120A or 120B which should open to permit exhaust can open in response to the hydraulic pressure of the displaced fluid.

In operation, the exhaust valve element 120A of engine 10A is opened during that portion of crank angle when combustion is occuring in combustion chamber 22B of engine 10B, forcing the exhaust valve element 120B to remain closed. The exhaust valve actuation piston 218 is displaced by the exhaust valve actuating cam 220, causing a displacement of fluid from the exhaust valve actuator piston 216, with the displaced fluid exerting pressure on the exhaust valve collar 126A and causing the exhaust valve stem 124A to move upward, separating the exhaust valve head 122A from the exhaust valve seat 84A, opening a gap through which exhaust of combustion gases occurs.

The subject invention provides several advantages. First, the subject invention includes a relatively simple method of assembling intake valve subassemblies 32 into the internal housing 12 by employing several, relatively smaller intake valve subassemblies 32 and providing a relatively large exhaust port surface 28 through which the intake valve subassemblies 32 may be positioned in the intake port surfaces 27. The exhaust valve subassembly 34 includes no springs or other mechanical means for causing the exhaust valve element 120 to follow the oscillating vertical motion of the internal housing 12, offering substantially improved reliability and durability. Furthermore, the exhaust valve subassembly 34 is relatively simple, and the exhaust valve element 120 and the exhaust valve cage 80 are easily assembled into the exhaust port surface 28 after the intake valve assemblies 32 have been assembled. The exhaust valve head 122, because of the coniform shape thereof, further contributes to forming a desirably shaped combustion chamber 22 having a "Mexican hat" shape. Furthermore, the coniform upper surface 102 of the exhaust valve tower 100 cooperates with the exhaust valve cage 80 to substantially reduce parasitic losses due to unusable volume in the secondary expansion chamber 26

Additionally, the exhaust valve subassembly 34, when used in conjunction with the exhaust valve actuation means 140, permits the use of the engine 10 in composite modular engines 200. The exhaust valve actuation means 140 is advantageously self-regulating when used in such composite modular engines 200 to assure that the proper exhaust valve element 120 is opened to permit exhaust from the proper combustion chamber 22. The exhaust valve actuation means 140 also consumes relatively little energy, with fluid being displaced by the vertical oscillations of the engines 10 resulting in no net fluid displacement, there being a net fluid displacement only during an actuation of an exhaust valve element 120.

Modifications to the preferred embodiment of the subject invention will be apparent to those skilled in the art within the scope of the claims that follow:

We claim:

1. A valve assembly for a dual compression/dual expansion internal combustion engine having an internal housing defining a combustion chamber and operating in a void defined in an external housing, said valve assembly comprised of:

a plurality of relatively smaller intake valve subassemblies disposed in a plurality of intake port surfaces in said internal housing to selectively communicate flow to said combustion chamber;

a relatively larger exhaust valve subassembly disposed in an exhaust port surface in said internal housing to selectively communicate flow from said combustion chamber, said exhaust valve subassembly having a volumetric flow substantially equal to the volumetric flow of the plurality of intake valve subassemblies.

2. The valve assembly as set forth in claim 1 wherein said exhaust valve subassembly further includes an exhaust valve element having a generally coniform exhaust valve head and an exhaust valve stem extending distally from said exhaust valve head.

3. The valve assembly as set forth in claim 2 wherein said exhaust valve subassembly further includes an exhaust valve cage secured to said internal housing.

4. The valve assembly as set forth in claim 3 wherein said exhaust valve cage further includes an exhaust valve cage upper end with an annular exhaust valve seat thereon.

5. The valve assembly as set forth in claim 4 wherein said exhaust valve cage further includes an exhaust valve securing means for securing said exhaust valve cage in said exhaust port surface.

6. The valve assembly as set forth in claim 5 wherein said exhaust valve subassembly further includes an exhaust valve tower fixed to said external housing.

7. The valve assembly as set forth in claim 6 wherein said exhaust valve tower further includes an exhaust valve guide disposed therein.

8. The valve assembly as set forth in claim 7 wherein said exhaust valve tower further includes an inner tower surface defining a generally cylindrical void in said exhaust valve tower.

9. The valve assembly as set forth in claim 8 wherein said exhaust valve stem extends through said exhaust valve guide and through the void defined by said inner tower surface, said exhaust valve stem further including an exhaust valve collar operating in said exhaust valve tower.

10. The valve assembly as set forth in claim 9 wherein said exhaust valve tower further includes a coniform tower upper surface which conforms to an exhaust valve cage pocket surface of said exhaust valve cage.

11. The valve assembly as set forth in claim 1 wherein said intake valve subassembly further includes an intake valve element having an intake valve head and an intake valve stem extending distally from said intake valve head.

12. The valve assembly as set forth in claim 11 wherein said intake valve subassembly further includes an intake valve guide in sliding engagement with said intake valve stem.

13. The valve assembly as set forth in claim 12 wherein said intake valve subassembly further includes an intake valve spring means for maintaining said intake valve element in a normally closed position.

14. The valve assembly as set forth in claim 13 wherein said intake valve spring means further includes an intake valve collar to said intake valve stem and an intake valve spring engaging said intake valve collar.

15. A method of assembling a valve assembly in an internal housing of a dual compression/dual expansion engine, the method including the steps of:

providing a plurality of relatively small diameter intake port surfaces communicating from a primary compression chamber to a combustion chamber in said internal housing;

providing a relatively large diameter exhaust port surface communicating from said combustion chamber to a secondary expansion chamber;

providing a like plurality of intake transfer valve subassemblies;

inserting said intake transfer valve subassemblies sequentially through said relatively large diameter exhaust port surface;

securing each said intake transfer valve subassembly in a respective intake port surface;

inserting an exhaust valve cage into said exhaust port surface.

16. The method of assembling a valve assembly in an internal housing of a dual compression/dual expansion engine, the method including the further step of providing an intake valve element having an intake valve head and an intake valve stem extending distally from said intake valve head.

17. The method of assembling a valve assembly in an internal housing of a dual compression/dual expansion engine as set forth in claim 16, the method including the further step of providing an intake valve spring means for each said intake valve subassembly for maintaining each said valve spring subassembly in a normally closed position.

18. The method of assembling a valve assembly in an internal housing of a dual compression/dual expansion engine as set forth in claim 17, the method including the further step of providing for each said intake valve subassembly an intake valve guide in sliding engagement with the intake valve stem.

19. The method of assembling a valve assembly in an internal housing of a dual compression/dual expansion engine as set forth in claim 18, wherein the step of securing each said intake transfer valve subassembly in a respective intake port surface includes the further step of causing an interference-fit engagement between said intake valve guide and said intake port surface.

20. The method of assembling a valve assembly in an internal housing of a dual compression/dual expansion engine as set forth in claim 15, including the further step of securing said exhaust valve cage in said exhaust port surface.

21. The method of assembling a valve assembly in an internal housing of a dual compression/dual expansion engine as set forth in claim 20, including the further step of providing in said exhaust valve cage an exhaust valve element having an exhaust valve head and an exhaust valve stem extending distally from said exhaust valve head.

22. The method of assembling a valve assembly in an internal housing of a dual compression/dual expansion engine as set forth in claim 21, including the further step of providing an annular exhaust valve seat in said exhaust valve cage.

23. The method of assembling a valve assembly in an internal housing of a dual compression/dual expansion engine as set forth in claim 22, including the further step of providing an exhaust valve guide in an exhaust valve tower secured to an external housing of said engine.

24. A valve assembly for a modular engine including a first dual compression/dual expansion internal combustion engine having a first internal housing defining a first combustion chamber and operating in a void defined in a first external housing, and further including a second dual compression/dual expansion internal combustion engine having a second internal housing defining a second combustion chamber and operating in a void defined in a second external housing, said valve assembly comprised of:

a first intake valve subassembly in said first internal housing, said first intake valve subassembly disposed in a first intake port surface in said first internal housing;

a second intake valve subassembly in said second internal housing, said second intake valve subassembly disposed in a second intake port surface in said second internal housing;

a first exhaust valve subassembly including a first exhaust valve element and a first exhaust valve cage disposed in a first exhaust port surface;

a second exhaust valve subassembly including a second exhaust valve element and a second exhaust valve cage disposed in a second exhaust port surface;

an exhaust valve actuation means connected to said first exhaust valve subassembly and said second exhaust valve subassembly, said exhaust valve actuation means further including a first fluid transfer line and a second fluid transfer line.

25. The valve assembly for a modular engine as set forth in claim 24 wherein said exhaust valve actuation means further includes a first fluid supply line in fluid flow connection with a fluid supply source.

26. The valve assembly for a modular engine as set forth in claim 25 wherein said exhaust valve actuation means further includes a third fluid transfer line in fluid flow connection with an exhaust valve actuator cylinder.

27. The valve assembly for a modular engine as set forth in claim 26 wherein said exhaust valve actuation means further includes an exhaust valve actuator piston moveably disposed in said exhaust valve actuator cylinder.

28. The valve assembly for a modular engine as set forth in claim 27 wherein said exhaust valve actuation means further includes an exhaust valve actuating cam for displacing said exhaust valve actuator piston.

29. The valve assembly for a modular engine as set forth in claim 28 wherein said first exhaust valve subassembly further includes a first exhaust valve tower defining a first upper valve stem chamber and a first lower valve stem chamber, and said second exhaust valve subassembly further includes a second exhaust valve tower defining a second upper valve stem chamber and a second lower valve stem chamber.

30. The valve assembly for a modular engine as set forth in claim 29 wherein said first fluid transfer line is in fluid flow connection between said first upper valve stem chamber and said second upper valve stem chamber, and said second fluid transfer line is in fluid flow connection between said first lower valve stem chamber and said second lower valve stem chamber.

31. The valve assembly for a modular engine as set forth in claim 30 wherein said third fluid transfer line is in fluid flow connection with said first lower valve stem chamber and said second lower valve stem chamber.

32. The valve assembly for a modular engine as set forth in claim 31 wherein said first fluid supply line is in fluid flow connection with said first upper valve stem chamber and said second upper valve stem chamber.

33. A method of operating an exhaust valve actuation means in a modular engine having a first dual compression/dual expansion engine including a first exhaust valve subassembly and a second dual compression/dual expansion engine including a second exhaust valve subassembly, the method including the steps of:

providing a first fluid transfer line in fluid flow connection with a first upper valve stem chamber in said first exhaust valve subassembly and a second upper valve stem chamber in said second exhaust valve subassembly;

providing a second fluid transfer line in fluid flow connection with a first lower valve stem chamber in said first exhaust valve subassembly and a second lower valve stem chamber in said second exhaust valve subassembly;

providing a first fluid supply line in fluid flow connection with a fluid supply source and with said first upper valve stem chamber in said first exhaust valve subassembly and said second upper valve stem chamber in said second exhaust valve subassembly;

providing a third fluid transfer line in fluid flow connection with an exhaust valve actuator cylinder and with said first lower valve stem chamber in said first exhaust valve subassembly and said second lower valve stem chamber in said second exhaust valve subassembly;

providing an exhaust valve actuator piston in said exhaust valve actuator cylinder;

providing an exhaust valve actuating cam for selectively actuating said exhaust valve actuator piston;

displacing said exhaust valve actuator piston with said exhaust valve actuating cam and displacing fluid in said exhaust valve actuator cylinder;

transferring said displaced fluid through said third fluid transfer line;

displacing fluid in said first lower valve stem chamber and said second lower valve stem chamber with said displaced fluid in said third transfer line; and selectively upwardly displacing and actuating a first exhaust element and a second exhaust element with said displaced fluid in said first lower valve stem chamber and said second lower valve stem chamber.

* * * * *